US006022300A

United States Patent [19]

Hightower

[11] Patent Number: 6,022,300

[45] Date of Patent: Feb. 8, 2000

[54] ROTATING GRIP BARBELL

[76] Inventor: Charlie H. Hightower, 12660 Valleywood Dr., Woodbridge, Va. 22191

[21] Appl. No.: 09/345,959

[22] Filed: Jul. 1, 1999

[51] Int. Cl.[7] ..... A63B 2/072

[52] U.S. Cl. ..... 482/106; 482/110

[58] Field of Search ..... 482/106–110, 139, 482/93; D21/680–682

[56] References Cited

U.S. PATENT DOCUMENTS

| | | | |
|---|---|---|---|
| Re. 33,218 | 5/1990 | Twardosz | 482/106 |
| 4,690,400 | 9/1987 | Metz | 482/106 |
| 4,770,409 | 9/1988 | Wallisch . | |
| 4,872,667 | 10/1989 | Favot | 482/106 |
| 4,903,962 | 2/1990 | Pollack | 482/106 |
| 5,078,392 | 1/1992 | Kracht . | |
| 5,211,616 | 5/1993 | Riley, Jr. . | |
| 5,334,113 | 8/1994 | Roepke . | |
| 5,399,133 | 3/1995 | Haber et al. . | |

FOREIGN PATENT DOCUMENTS 2186500 8/1987 United Kingdom .

*Primary Examiner*—John Mulcahy
*Attorney, Agent, or Firm*—Richard C. Litman

[57] ABSTRACT

A rotating multi-positional grip barbell device having a plurality of hand grip portions rotatably mounted relative to a bar, includes a housing assembly fixedly mounted to the bar, wherein the housing assembly is diametrically aligned relative to the bar, and a carrier ring support rotatably mounted relative to the housing assembly. A pair of bearing sets provide relative frictionless rotation between the housing assembly and the carrier ring support. An alternative embodiment includes an offset configuration of the weight supporting ends with the barbell having the rotating hand grips. The offset weight supporting ends are rotatable via a pair of swivel joints. The multi-positional grip provides a weightlifting exercise regimen that produces greater muscle toning and muscle building results.

19 Claims, 6 Drawing Sheets

ROTATING GRIP BARBELL

BACKGROUND OF THE INVENTION

1. Field of the Invention

The present invention relates to a weightlifting apparatus, and more particularly, to a new and improved weightlifting barbell apparatus with a multi-position grip system that permits a weightlifter to perform multi-axis hand, arm, and shoulder rotations while performing bench press type exercises.

2. Description of the Related Art

In the sport of weightlifting, barbells arranged to lift various weights are utilized. Barbells typically consist of various types of bars, such as curling bars, that are configured having a bent portion to accommodate various grasping orientations of a weightlifter's manual grasping of the bar. In recent years, weightlifting has become an increasingly popular form of exercise. Most weight training exercises can be performed using either one-handed dumbbells, consisting of a short bar with weights either end, or two-handed barbells, consisting of a straight bar with weights at both ends.

Since one dumbbell is held in each hand, a user can freely rotate the wrist and hand throughout the full range of motion as an exercise is performed. For example, in performing a shoulder press with dumbbells, a user holds a dumbbell in each hand directly beside the shoulders, with palms facing toward each other. Then the dumbbells are raised over the head, and the palms are rotated to face forward. Finally, the palms are rotated back to the starting position as the weights are lowered.

The same exercise can be performed with a barbell by grasping the bar with an overhand grip, straightening up and lifting the weight to shoulder level, then lifting the bar up over the head. Heavier weights can be lifted using the barbell because it permits greater balance and control. However, the hands and wrists must be held in a relatively fixed position, and may be rotated only along the axis of the bar. On the other hand, barbells such as curling bars are configured with a bent portion to accommodate various grasping orientations of an individual weightlifter's manual grasping of the bar. Also, exercising using a fixed hand and arm dispositions tend to increase the stresses, and ultimately, injures the muscles of the shoulders and collar.

Thus, it is not possible to use a standard barbell to exercise the groups of muscles involved in pronation and supination as with dumbbells. Moreover, the necessity of maintaining such a fixed position during exercises with the heavier barbell increases strain on the wrists and elbows. In addition, safety is compromised by the inability to reposition grip in the midst of a lift or exercise to obtain better control.

Prior art devices have attempted to impart some wrist rotation to the standard barbell, but do not provide a full range of motion for a user and are generally not adaptable for attachment to a weight or similar exercise machine. U.S. Pat. No. 4,770,409, issued Sep. 13, 1988 to Wallisch, describes a wrist exercising device that permits rotation of handles against springs in a "figure eight" shaped housing.

U.S. Pat. No. 5,078,392, issued Jan. 7, 1992 to Kracht, describes a rotatable sleeve for a weightlifting barbell.

U.S. Pat. No. 5,211,616, issued May 18, 1993 to Riley, Jr., discloses a weightlifting bar apparatus having rotatably movable hand grips relative to the bar. The hand grips provide an inner compartment for housing a rosin bag to maintain dry palms, increasing the ability to hold the barbell. Prior art FIGS. 6 and 7 of the instant application, are illustrative views of the Riley, Jr. device.

U.S. Pat. No. 5,334,113, issued Aug. 12, 1994 to Roepke, discloses a rotatable grip weight exercise handles that permit rotation of the handles on a single axis perpendicular to the rod.

U.S. Pat. No. 5,399,133, issued Mar. 21, 1995 to Haber et al., discloses a universal joint type assembly for appendage interfacing with an exercising machine.

British Patent Document No. 2,186,500, published Aug. 19, 1987, shows an exercise bar having rotatable handles within a pair of circular openings of a barbell frame member.

There are many ways to use weightlifting as part of an exercise regimen. Various devices and methods are conventionally available. Commonly found devices for lifting or simulated lifting of weights are Universal Gyms®, Nautilus®, BullWorker® I and II, as well as a host of other machines and devices using resilient bands, springs, cables, pulleys, etc. One of the oldest and most commonly used weightlifting forms is "free weights" mainly using barbells (i.e., an elongated bar having equal amounts of weight mass on each end used with both hands), and dumbbells (i.e., a single handed barbell type device used alone or in pairs).

Barbells allow a weightlifter to accommodate a significantly great amount of weight because of the two handed control and balance. On the flip side, dumbbells provide a wider range of exercise routines for producing the desired muscular results. An example of an exercise that is more beneficial using dumbbells is when in a horizontal or a near horizontal position, holding a pair of dumbbells at chest level in a parallel, non-linear relationship, the weights are pushed upwards away from the chest. During the upward motion, the wrists and arms are turned so as to have the dumbbells in a linear relationship coincident with the extreme extension of the arms. Reversing the motion completing a single cycle. Conventional dumbbells do not allow this type of exercise using a great deal of weight. Likewise, conventional barbells do not allow the specific arm motions, even though a significant amount of weight is used.

Many persons have chosen to incorporate weightlifting, using free weights, into their physical fitness training for at least muscular tone. Also, avid weightlifting enthusiasts use free weights because of the natural ability to overcome gravity in order to move the weight. The use of free weights allows a person to add many variations to the standard exercises provided through the above mentioned devices. Particularly, the bench press provides an enormous amount of muscle exercises for training and toning purposes. Specifically, greater emphasis is devoted to increased arm motions and greater range of arm, shoulder, and collar exercises.

None of the above inventions and patents, taken either singularly or in combination, is seen to describe the instant invention as claimed. Thus a rotating grip barbell solving the aforementioned problems is desired.

SUMMARY OF THE INVENTION

The present invention pertains to a rotating multi-positional grip barbell having a plurality of hand grip portions rotatably mounted relative to a bar, includes a housing assembly fixedly mounted to the bar, wherein the housing assembly is diametrically aligned relative to the bar, and carrier ring support rotatably mounted relative to the housing assembly. A pair of bearing sets provide relative frictionless rotation between the housing assembly and the carrier ring support.

An alternative embodiment includes an offset configuration of the weight supporting ends with the barbell having the rotating hand grips. The offset weight supporting ends are rotatable via a pair of swivel joints. The offset weights provides an excellent avenue for rehabilitating injured muscles. Particularly, the rotator muscles of the shoulders and collar. The offset weights, along with the rotating grips, prevent unwanted inertial rotations and oscillations of the barbell.

Accordingly, it is a principal object of the invention to provide a barbell device that allows dumbbell exercises with increased weight mass amounts.

It is another object of the invention to provide a barbell device that allows improved balance and control during dumbbell exercises with increased weight mass amounts.

It is a further object of the invention to provide a barbell deice having rotatable grips.

Still another object of the invention is to provide a barbell device having weight supporting ends and collars rotatably offset from the bar.

It is a still another object of the invention is to provide a barbell device having weight supporting ends and collars rotatably offset from the bar, and having rotatable grips.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
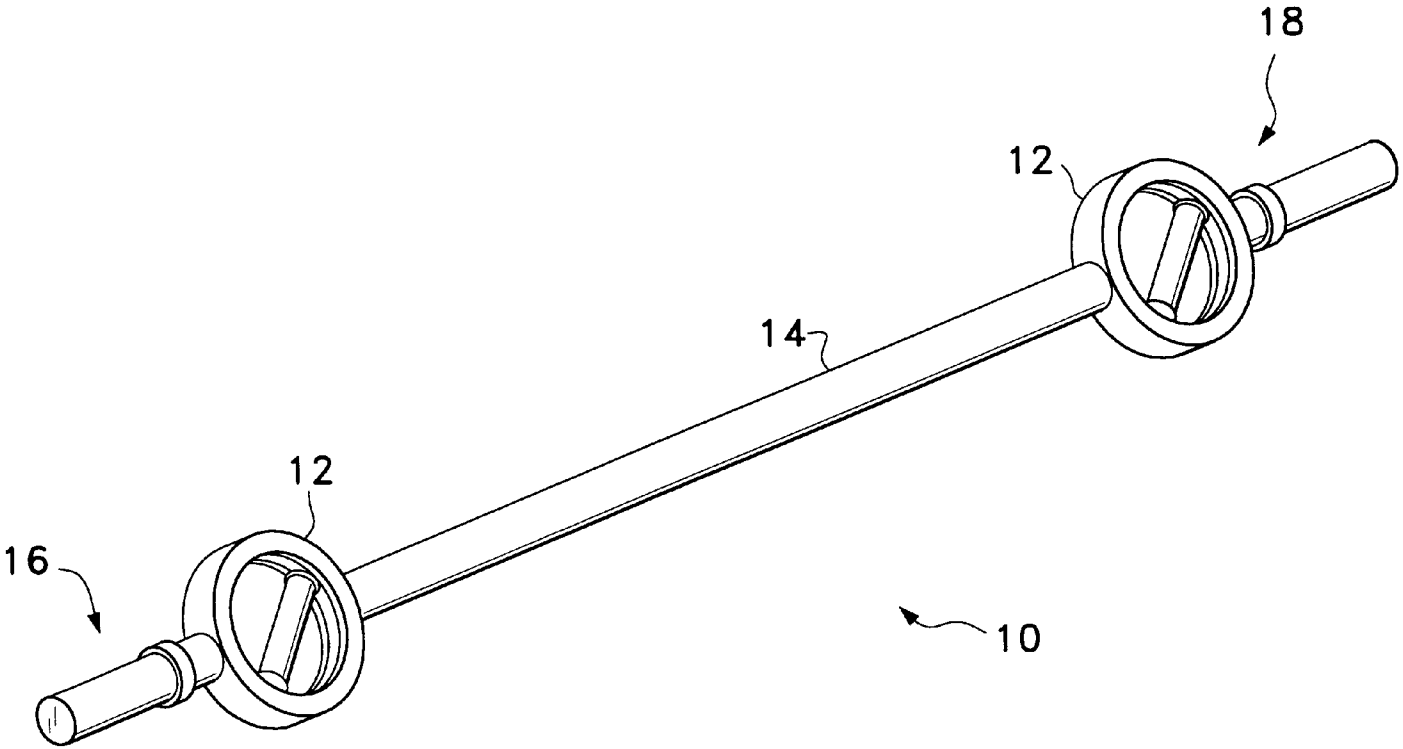
FIG. 1 is a perspective view of a rotating grip barbell according to a first embodiment of the present invention.

The present invention described herein is shown primarily in FIG. 1. In this figure the invention is represented generally as barbell 10. The parameters defining the barbell 10 are virtually identical to conventional competition or Olympic style barbells, that is, barbell 10 has the same overall length, mass/weight, and diameter as a competition or Olympic style barbell. The barbell 10 includes a bar having a first end 16, a second end 18, and an intermediate region 14. The first end 16 has a weight supporting section including an inner collar 20 and an outer collar (not shown). Typically, the collars receive and secure weight plates, typically circular weight plates therebetween, so as to retain and hold the weights in place. The inner collar also provides a standard stop position preventing the weights from encroaching toward the intermediate region 14 of the bar. Likewise, the second end 18 has a weight supporting section including an inner collar and an outer collar for receiving and securing circular weight plates therebetween The weight supporting sections have a diameter slightly larger than the diameter of the intermediate region of the bar. Typically, the conventional or Olympic size bar is 1.25 inches (approx. 42 mm) in diameter, while the weight supporting end sections are typically 1.87 inches (approx. 63 mm). The weight plates supported at each end of the bar are equal in mass quantity.

The intermediate region 14 of the bar includes a center point about which the barbell 10 is symmetrical and balanced. Equidistant from the center of the barbell 10, and on opposite sides thereof, are a first handle 12, and a second handle 12. The first and second handles 12 are used in the manipulation of the barbell 10 during an exercise regimen. The handles 12 each include a omni-positionable, universally rotating hand grip 54. The universally rotating hand grip 54 of the handles provide a substantially frictionless motion during exercises for maximum benefit. The structure of the universally rotating hand grips 54 of the handles is seen in FIGS. 2 and 3.

Figure 2:
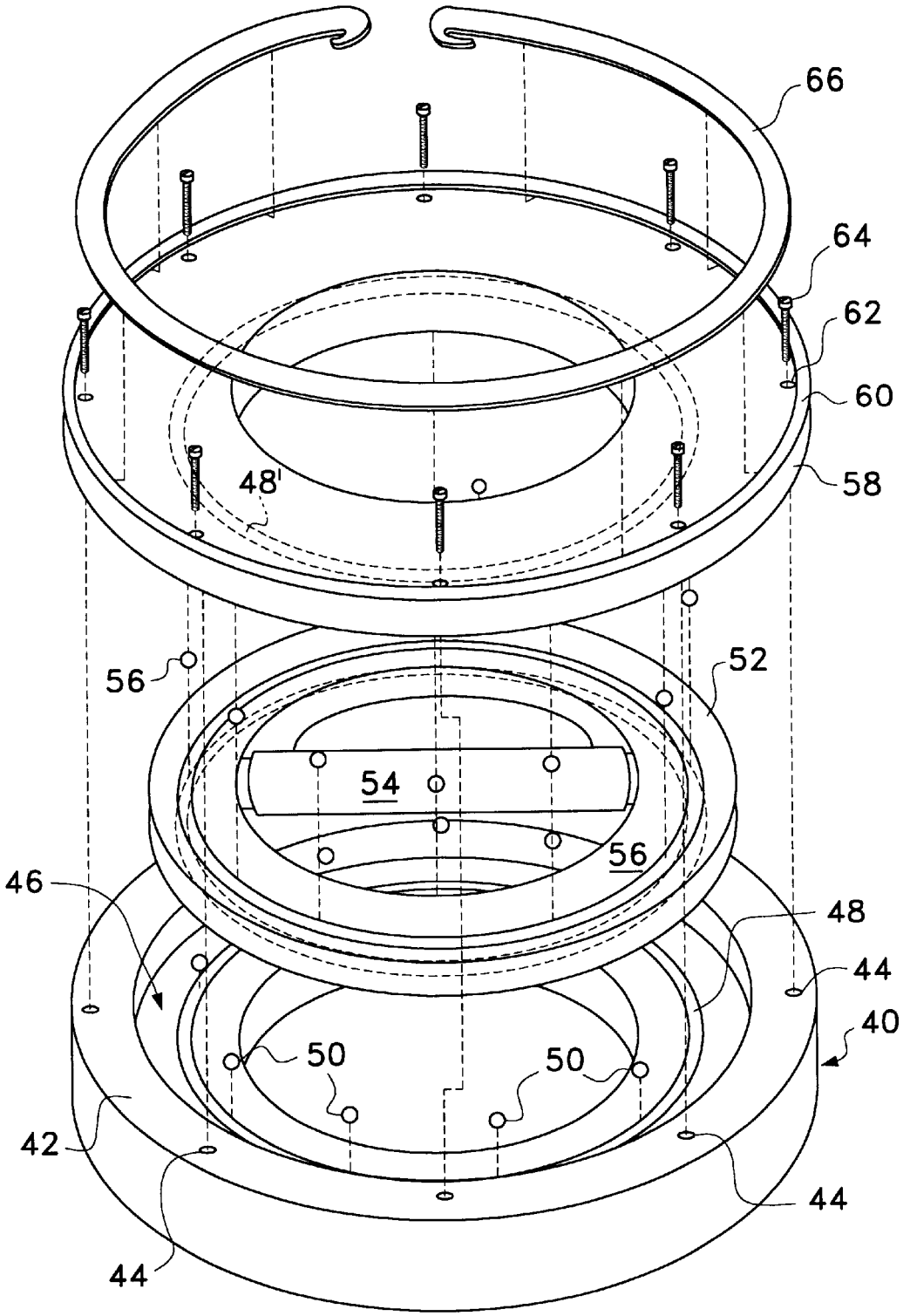
FIG. 2 is an exploded view of the rotating grip according to the invention.
Figure 3:
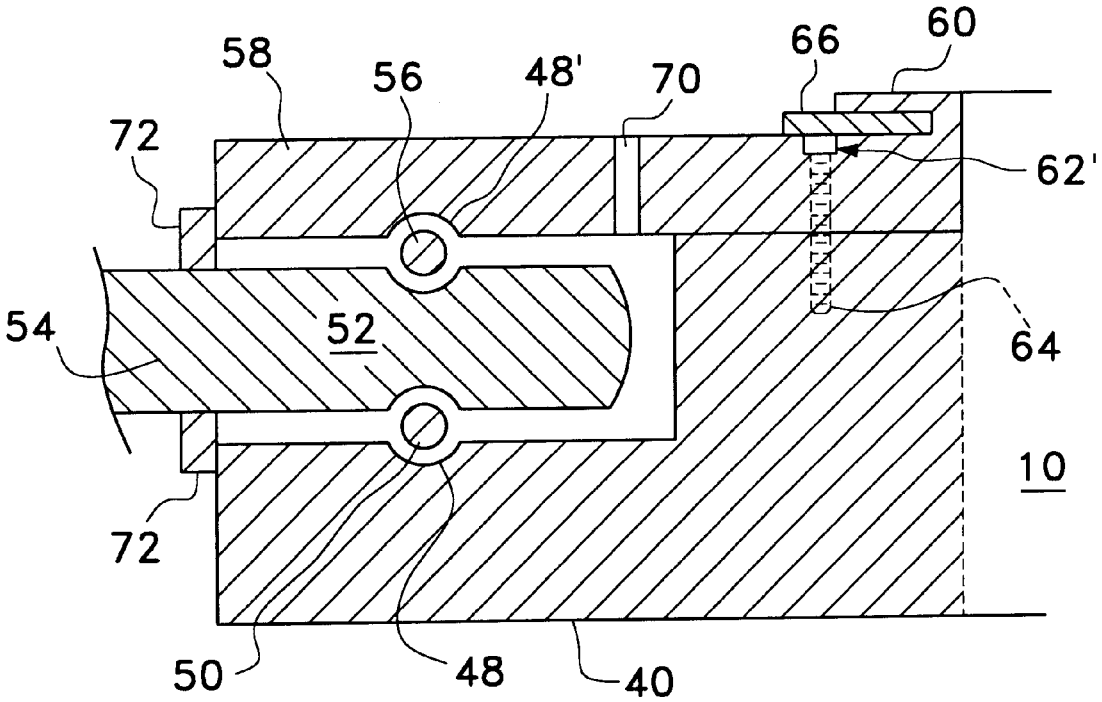
FIG. 3 is a cross-sectional view of the rotating grip along line 3—3 of FIG. 1 of the present invention.

In FIG. 2, the rotating grip 12 is shown in an exploded perspective view, and in FIG. 3, a cross-sectional view is shown, in order to illustrate the structural intermakings of the invention. Each handle or rotating grip 12 has the structure described herein. A circular housing base 40 is integrally formed into the barbell 10. This formation may be molded, forged, or welded. The base 40 includes an outer wall forming a shell 42 defining a internal well 46. The outer shell 42 has a plurality of receivers 44 for anchors 64. The internal well 46 has a race 48 for receiving a plurality of ball bearings 50. The ball bearings 50 are arranged tangentially, completely encircling the race 48 (not shown in entirety for the sake of clarity). The race 48, in its simplest form, is merely a grooved track inscribed in the internal well 46. It is well within the purview of the scope of the invention, that the race 48 may include, but not be limited to, a track, cage, or any other known devices for establishing a bearing race 48.

The hand grip 54 may include a knurled, or ridged surface (not shown) for increased grasping ability. Likewise, the hand grip 54 may include a solid sleeve or a resilient sleeve (also, not shown). These particular optional features associated with are well within the knowledge of the skilled artisan, and need not to be address.

Residing atop of the ball bearings 50 is a support ring carrier 52 for the hand grip 54. The support ring carrier 52 is integrally formed with the hand grip 54. The support ring carrier 52 has an upper bearing surface and a lower bearing surface which may be slightly grooved or flat. The lower bearing surface engages the ball bearings 50 of the internal well 46 bearing race 48. The upper bearing surface encounters another set of ball bearings 56.

The ball bearings 56 on the upper bearing surface, like the ball bearings 50 of the well 46, are tangentially arranged, and are however, not shown herein for the sake of clarity. The ball bearings 56 traverse a race 48' formed in a housing cover 58. Like the race 48 of the internal well 46, the race 48' of the housing cover 58 is, in its simplest form, a grooved track inscribed in the housing cover 58. Hereto, it is well within the purview of the scope of the invention, that the race 48' may include, but not be limited to, a track, cage, or any other know devices for establishing a bearing race.

A plurality of apertures 62 of are provided in the housing cover 58, and are aligned with the receivers 44 of the base 40 outer shell 42. The apertures 62 aligned with the receivers 44 accept anchors 64 therein. The anchors 64 are simply fasteners for fixedly holding the housing cover 58 to the housing base 40. The anchors 64 may be in the simplest form, screws, where the receivers 44 are tapped holes and the apertures 62 may be tapped or through. On the other hand, the anchors 64 may be any suitable fastener, such as bolts, turnkeys, clamps, and the like wherein the receivers 44 would the appropriate form to accommodate the fastener. The apertures 62, in the preferred embodiment, have enlarged recesses 62' for seating the heads of the anchors 64 flush or just beneath the surface of the housing cover 58.

The housing cover 58 also has a radially inward flange 60 around the external periphery. The flange 60 extends to a point juxtaposed to the circle encompassing and circumscribing the apertures 62. A spring clamp 66 is seated under the flange 60. The spring clamp 66 serves as an additional locking mechanism, preventing the premature release of the anchors 64 from the base 40. The spring clamp 66 has a pair of eyelets or hooked ends that allow a clamp tool, such as needle nose pliers, to grasp and compress the spring clamp 66 during the insertion or removal thereof.

In addition, the housing cover 58 has an additional aperture 70 and plug (not shown) that serves as a port for admitting lubrication into the interior of the assembled rotating grip. Any conventional lubrication for metal to metal contact is acceptable. Lubrications that are petroleum based (such as oils, greases, etc.), synthetic based, or silicone based are useable for permitting the rotation of the support ring carrier 52 between the lower and upper sets of ball bearings 50, 56. This allows the hand grip 54 to rotate as frictionless as possible. A gasket 72 (as seen in FIG. 3) is used for preventing any lubrication from seeping onto the hand grip 54 and thereby reducing the grasping capability.

The rotating hand grip 54 allows the weightlifter to perform dumbbell type exercises, using greater weight masses, with the stability and balance attributed to a barbell 10. In essence, the barbell 10 allows greater mobility in exercising more hand, arm, and shoulder muscles. This is accomplished by the fact that a greater range of mobility is gained. Moreover, the barbell 10 provides more muscle toning/training action for the weightlifter. For example, the above mentioned bench exercise, allows the weightlifter to bench press the rotating grip barbell 10 having his hands initially holding the hand grips 54 in a parallel, non-linear position adjacent to his chest, pressing the barbell 10 upwards until his arms are fully extended, and the hand grips 54 are held in a linear position at the extreme of the arm extension. Thus, the use of barbell 10 increases the metabolic reactions of the body during exercise routines.

Figure 4:
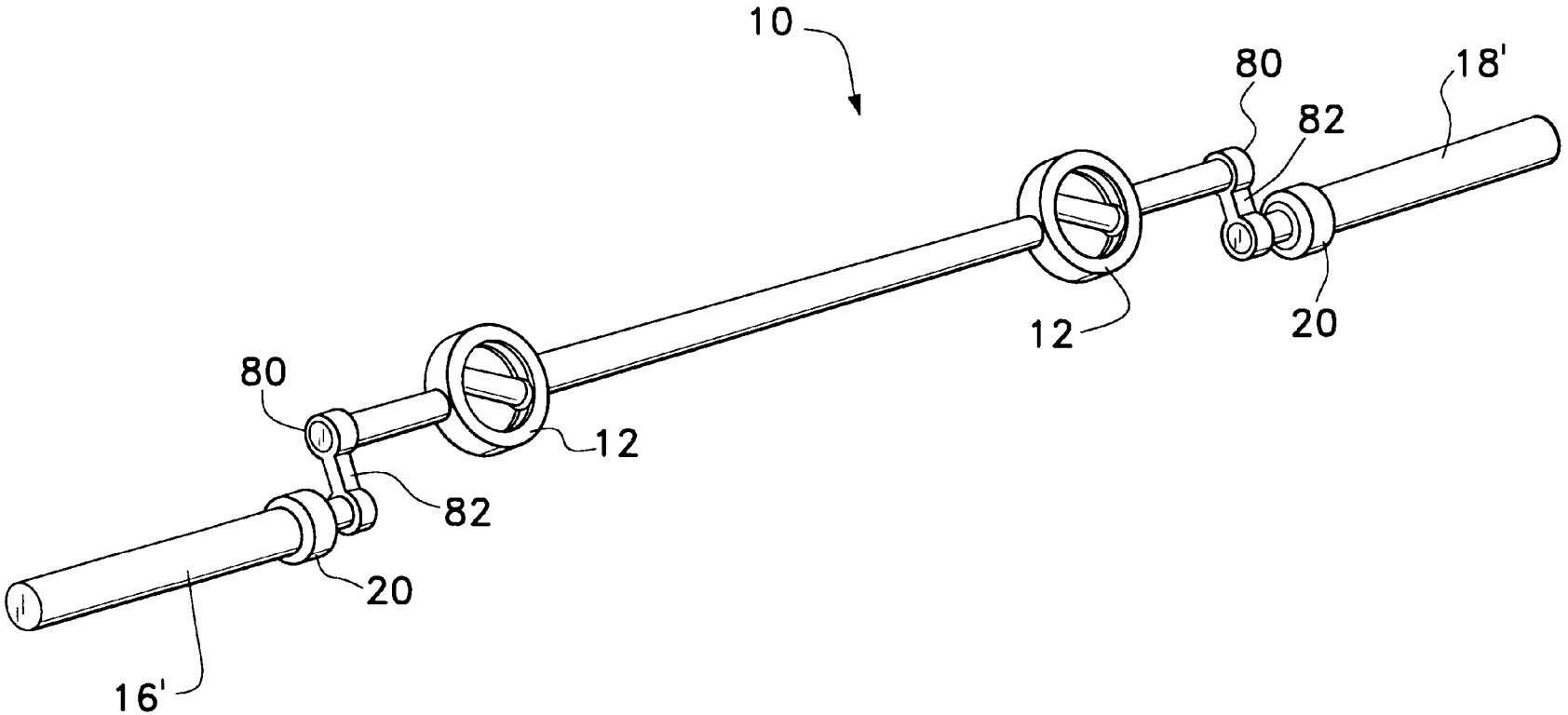
FIG. 4 is a perspective view of a rotating grip barbell according to a second embodiment of the present invention.
Figure 5B:
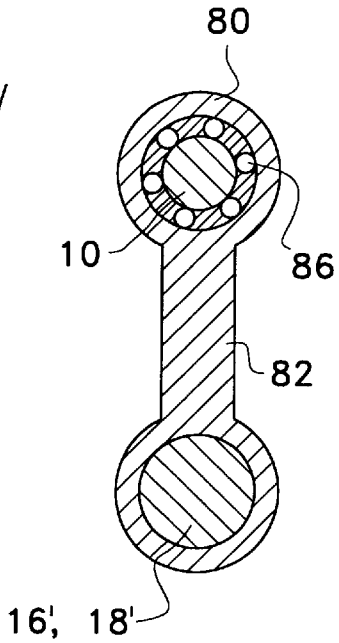
FIGS. 5A and 5B are an elevational view and a cross-sectional view along line V—V of FIG. 5A of the swivel joint of the second embodiment of the present invention.
Figure 5A:
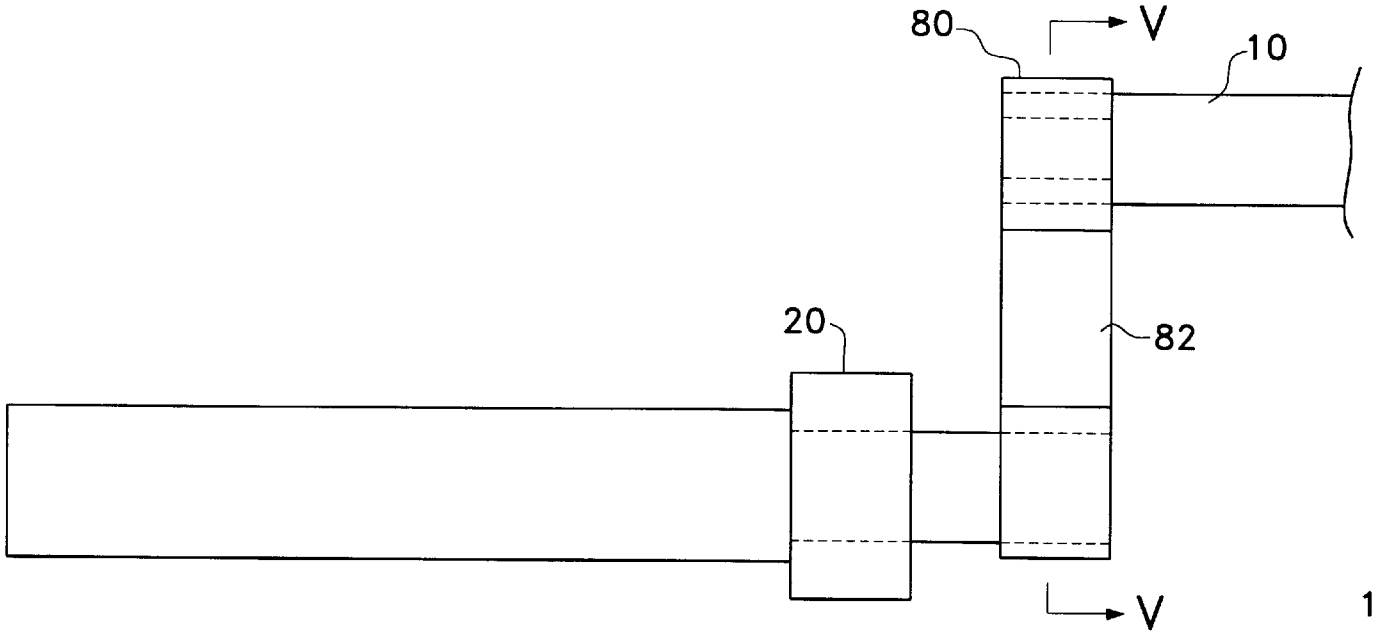
Figure 6:
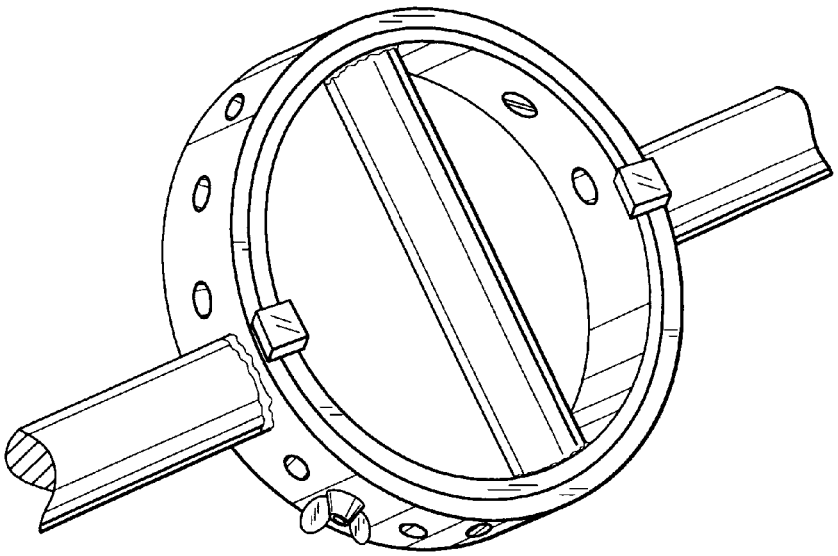
Fig. 6 PRIOR ART
FIGS. 6 and 7 are representative views of the prior art weight lifting devices.
Figure 7:
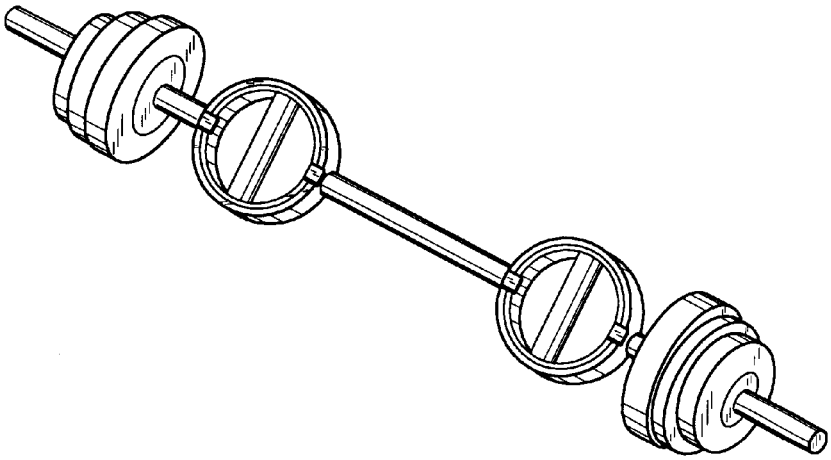
Fig. 7 PRIOR ART

In an alternative embodiment, as seen in FIGS. 4, 5A, and 5B, the barbell 10 having the rotating grips, is altered to provide the weight masses offset from the plane of the barbell 10. The offset weight masses provide rehabilitation for injured muscles. The rotator muscles of the shoulders and collar are specifically targeted for training and/or toning while bench pressing using barbell 10. The offset weights, along with the rotating grips, prevent unwanted inertial rotations and oscillations of the barbell. In order to provide the offset, the length of the initial barbell 10 of FIGS. 1–3 is shortened between the circular housing 40 of the rotating grips 54 and the inner collars 20. A swivel joint 80 is formed in the shortened ends. An L-shaped armature formed between extension 82 and shortened ends 16', 18' extends from the swivel joint 80 forming the offset of the weight supporting collars 20 and the barbell 10.

The swivel joint 80 is composed of a ring carrying a set of bearings 86 circumferentially about the shortened ends of the barbell 10. The bearings 86 may be either ball bearings or roller bearings. Roller bearings are preferred because of the ease of manufacturing the shortened ends to accommodate the circumferential rotation while inhibiting lateral movements along the axis of the barbell 10. The purpose of the swivel joint 80 for offsetting the weight masses is two-fold.

First, when the barbell 10 is supported on a bench press, or other type, rack or other conventional vertical surface support, the stresses placed upon the supporting structure are reduced because the length of the torque arm is shortened. Second, the muscle building effects of the pendulating weight masses increases due to the varying force vectors acting upon the weight lift via the offset barbell 10. Thereby increasing the effects of exercising the rotator muscles, shoulder muscles, arm muscles, and hand muscles.

It is to be understood that the present invention is not limited to the embodiments described above, but encompasses any and all embodiments within the scope of the following claims.

I claim:

1. A rotating grip exercising device for use in an exercising regimen for increasing muscular strength by providing a full compliment of arm movements, said rotating grip exercising device comprising:

a bar having a first end, a second end, and an intermediate region;

said first end having first collar means for receiving and securing first circular weight plates thereon;

said second end having second collar means for receiving and securing second circular weight plates thereon;

wherein the mass quantity of the first circular weight plates being substantially equal to the mass quantity of the second weight plates;

said intermediate region of said bar including a center point, a first handle, and a second handle;

said first and second handle being equidistant from said center point, said first and second handles for manipulating said bar in an exercise regimen, and said first handle and said second handle each including a universally rotating grip, said universally rotating grip of each first and second handle comprising: an upper race, a lower race, a grip member rotatable between said first race and said second race, a plurality of fasteners securing said upper race to said lower race, and a spring clamp engaging a circumferential flange in one of said races, wherein said spring clamp conceals said fasteners;

wherein said first and second handles providing substantially frictionless motion of said universally rotating grip.

2. The device according to claim 1, wherein:

each said first and second handle includes a circular housing integrally formed in said bar;

said circular housing having a race well, a first means for providing a bearing, a grip carrier ring, a second means for providing a bearing, and a race cap;

wherein said grip carrier ring includes an upper bearing surface, and a lower bearing surface.

3. The device according to claim 2, wherein:

said race cap having a fastening means for fastening said race cap to said race well.

4. The device according to claim 3, wherein:

said fastening means for fastening are selected from the group consisting of screws, bolts, turnkeys, and clamps.

5. The device according to claim 3, wherein:

said race cap includes, port means for administering lubrication into said housing, and gasket means for preventing lubrication seepage from said housing.

6. The device according to claim 2, wherein:

said first means for providing a bearing includes a plurality of ball bearings tangentially arranged about said well race;

said second means for providing a bearing includes a plurality of ball bearings tangentially arranged about said cap race;

said lower bearing surface of said grip carrier ring being adjacent to said first means for providing a bearing;

said upper bearing surface of said grip carrier ring being adjacent to said second means for providing a bearing; and said grip member diametrically disposed across said grip carrier ring.

7. The device according to claim 1, further comprising:

offsetting means disposed respectively at said first and said second ends for parallel offsetting said first and said second collar means from said bar;

wherein each said offsetting means allowing rotation of each said first and said second collar means in a plane perpendicular to each respective said first and said second end.

8. The device according to claim 1, wherein:

said universally rotating grip of each first and second handle comprises:

a circular housing integrally formed in said bar, a first plurality of ball bearings tangentially arranged about said lower race, a second plurality of ball bearings tangentially arranged about said upper race, a grip having a support ring disposed between said first plurality of ball bearings and said second plurality of ball bearings, wherein said support ring includes a pair of bearing surfaces against said first and second plurality of ball bearings; and said grip member diametrically disposed across said support ring.

9. The device according to claim 8, wherein:

said housing includes a gasket; and said upper bearing race having a lubrication port.

10. The device according to claim 9, wherein:

said support ring being disposed internally of said housing;

said grip member being diametrically disposed across said housing; and said gasket preventing seepage of a lubricant from said housing about said support ring and said grip handle.

11. A weightlifting exercise device for use in an exercising regimen for increasing muscular strength by providing a full compliment of arm movements therethrough, said weightlifting exercise device comprising:

a bar having a first end, a second end, and an intermediate region;

said first end having first collar means for receiving and securing first circular weight plates thereon;

said second end having second collar means for receiving and securing second circular weight plates thereon;

first offset means for rotatably supporting said first collar means parallel to said bar at said first end;

second offset means for rotatably supporting said second collar means parallel to said bar at said second end;

wherein the mass quantity of the first circular weight plates being substantially equal to the mass quantity of the second weight plates;

said intermediate region of said bar including a center point, a first handle, and a second handle;

said first and second handle being equidistant from and in opposition across said center point, said first handle and said second handle each including a universally rotating grip, said universally rotating grip of each first and second handle comprising: an upper race, a lower race, a grip member rotatable between said first race and said second race, a plurality of fasteners securing said upper race to said lower race, and a spring clamp engaging a circumferential flange in one of said races, wherein said spring clamp conceals said fasteners;

wherein said universally rotating grip providing substantially frictionless motion of said first and second handles;

wherein said first end and said second end being equidistant from said center point; and wherein each said first offset means and said second offset means allowing rotation of each said first and second collar means in a plane perpendicular to each respective said first and said second end.

12. The device according to claim 11, wherein:

said first and said second offset means each comprise, a rotational bearing for allowing rotation of each said first and said second collar means about respective said first and said second ends, and for preventing linear movement along said bar, and a rod member extending from said rotational bearing perpendicularly from said bar;

wherein said rod member supports said first and said second collar means parallel to said bar.

13. The device according to claim 12, wherein:

said rotational bearing includes an inner bearing race formed in each said end of said bar, an outer race, and a set of bearings.

14. The device according to claim 13, wherein:

said set of bearings is selected from the group consisting of roller bearings and ball bearings.

15. The device according to claim 11, wherein:

said first and said second offset means each comprises, a swivel bearing for allowing rotation of each said first and said second collar means about respective said first and said second ends, and for preventing linear movement along said bar, and an L-shaped arm member extending from said rotational bearing perpendicularly from said bar;

wherein said L-shaped arm member supports said collar means parallel to said bar.

16. The device according to claim 15, wherein:

said swivel bearing including an inner bearing race formed in each said end of said bar, an outer race, and a set of bearings disposed between said inner and said outer bearing race;

wherein said set of bearings is chosen from the group consisting essentially of roller bearings and ball bearings.

17. A weightlifting device comprising:

a bar having a first end, a second end, and an intermediate region;

said first end including first collar means for receiving and securing first circular weight plates thereon, and first offset means for rotatable supporting said first collar means parallel to said bar;

said second end having second collar means for receiving and securing second circular weight plates thereon, and second offset means for rotatably supporting said second collar means parallel to said bar;

wherein each said first offset means and said second offset means allowing rotation of each said first and said second collar means in a plane perpendicular to each respective said first and said second end;

said intermediate region of said bar including a center, a first handle housing, and a second handle housing, said first and second handle housings being equidistant from and in opposition across said center;

said first handle housing and said second handle housing each including a grip omni-positionably disposed therein;

wherein said grip having substantially frictionless motion within each said first and said second handle housings;

wherein each said first handle housing and said second handle housing consists of, a circular housing base integrally formed in said bar, an circular housing cover, a lower bearing race disposed in said base, an upper bearing race disposed on said cover, a first plurality of ball bearings tangentially arranged about said lower race, a second plurality of ball bearings tangentially arranged about said upper bearing race, a support ring disposed between said first plurality of ball bearings and said second plurality of ball bearings, a grip member disposed across said support ring, and securing means for fixedly securing said cover to said base so as to allow rotation of said support ring;

a radially inward circumferential flange in said cover; and a spring clamp engaging said radially inward circumferential flange, wherein said spring clamp conceals said securing means.

18. The device according to claim 17, wherein:

said securing means include a plurality of fasteners selected from the group consisting of screws, bolts, turnkeys, and clamps.

19. The device according to claim 18, wherein:

said first handle housing and said second handle housing each include, port means for administering lubrication into said housing and;

gasket means for preventing lubrication seepage from said housing.

* * * * *